United States Patent [19]

Altmann

[11] Patent Number: 4,998,141

[45] Date of Patent: Mar. 5, 1991

[54] ELECTRET TONER CONCENTRATION MONITOR

[75] Inventor: Conrad Altmann, Rochester, N.Y.

[73] Assignee: Eastman Kodak Company, Rochester, N.Y.

[21] Appl. No.: 575,060

[22] Filed: Aug. 31, 1990

[51] Int. Cl.[5] ..... G03G 21/00

[52] U.S. Cl. ..... 355/246; 118/691; 355/20 B; 355/208; 356/440

[58] Field of Search ..... 355/203, 208, 246; 356/440, 441, 445; 118/689, 690, 691; 73/864.71

[56] References Cited

U.S. PATENT DOCUMENTS

| | | | |
|---|---|---|---|
| 4,135,100 | 1/1979 | Harada et al. | 356/440 X |
| 4,256,402 | 3/1981 | Nishikawa | 356/440 X |
| 4,441,038 | 4/1984 | Tanaka et al. | 307/400 |
| 4,447,145 | 5/1984 | Snelling et al. | 356/445 X |

FOREIGN PATENT DOCUMENTS

| | | | |
|---|---|---|---|
| 0006561 | 1/1979 | Japan | 355/246 |
| 0080879 | 5/1985 | Japan | 355/246 |
| 0105948 | 6/1985 | Japan | 356/445 |

*Primary Examiner*—A. T. Grimley
*Assistant Examiner*—J. E. Barlow, Jr.
*Attorney, Agent, or Firm*—Milton S. Sales

[57] ABSTRACT

A toner concentration monitor includes a polarized dielectric member which, when dipped into a development mixture of carrier and toner particles, provides an accurate indication of the toner concentration of the mixture by the amount of toner particles which adhere to the member. The polarized dielectric member is preferably an electret.

10 Claims, 2 Drawing Sheets

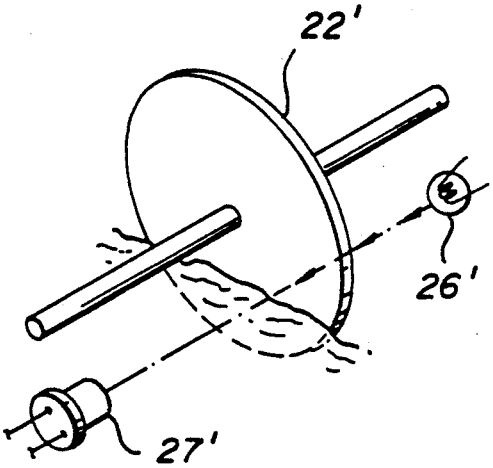
Fig. 3
Fig. 4
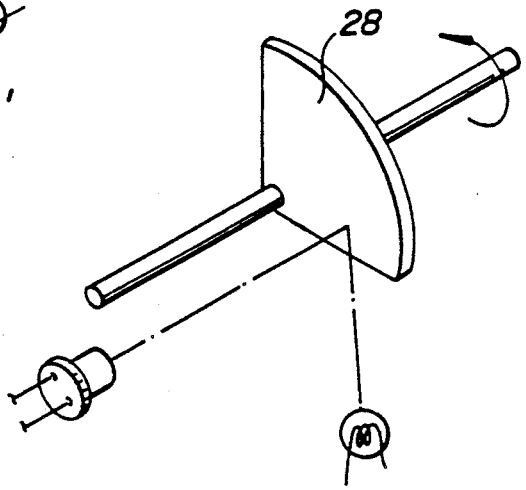
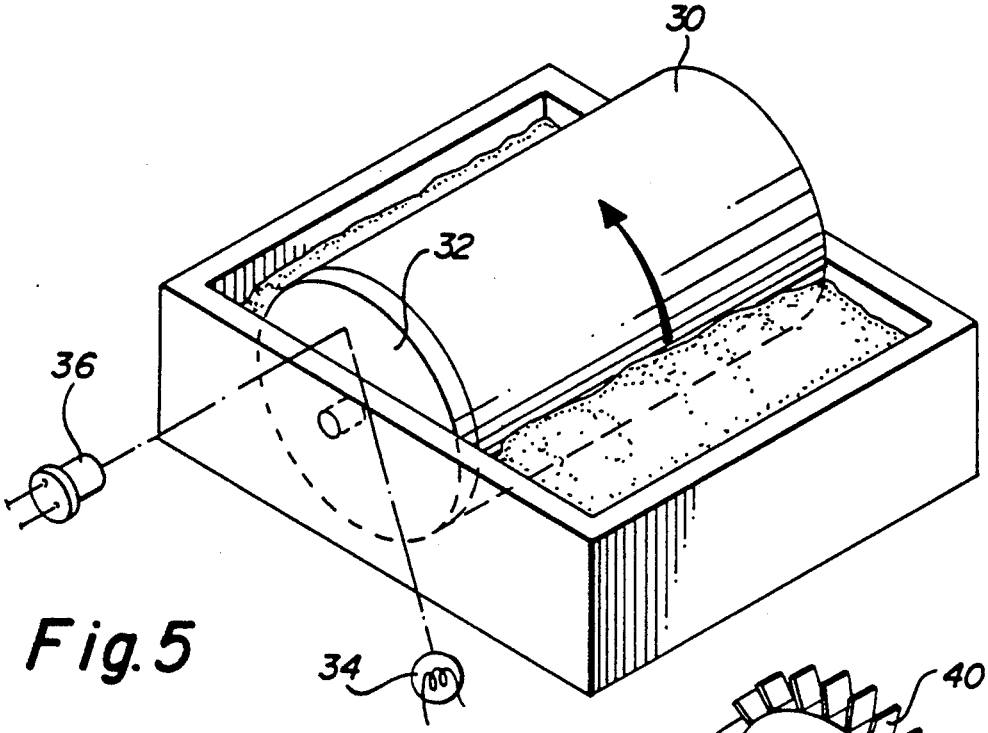
Fig. 5
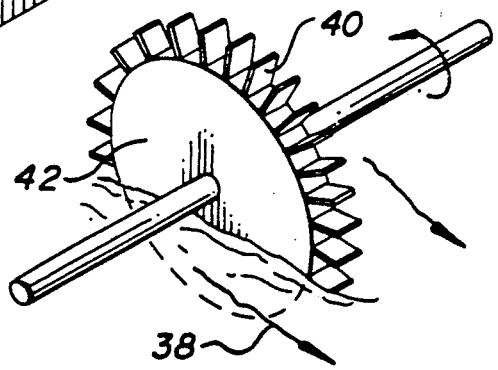
Fig. 6

ELECTRET TONER CONCENTRATION MONITOR

BACKGROUND OF THE INVENTION

1. Technical Field

This invention relates generally to the field of electrostatography, and more particularly to improvements in apparatus for detecting the concentration of toner particles in a development mixture of carrier and toner particles.

2. Background Art

In electrostatography, electrostatic images formed on a dielectric recording element are rendered visible via the application of pigmented, thermoplastic particles known as toner. Typically, such toner forms part of a two-component development mixture consisting of magnetically-attractive carrier particles and toner particles. The carrier and toner particles adhere together via triboelectric forces. During the development process, the electrostatic forces associated with the latent image act to strip the toner particles from their associated carrier particles, and the partially denuded carrier particles are returned to a reservoir.

It is well known in the art to continuously monitor the toner concentration in an electrostatographic development mixture and to replenish the mixture with toner when the concentration thereof falls below a predetermined level. For example, commonly assigned U.S. Pat. No. 4,141,645, which issued to M. G. Reid et al. on Feb. 27, 1979, includes a toner monitor which inspects the development mixture through an optical window in the reservoir to generate a signal related to the mixture's reflectivity; and therefore to its toner concentration. While such systems are generally effective, they are subject to some drawbacks. For example, the carrier and toner particles must be optically distinguishable (as in the case of a dry toner/carrier mixture) or the carrier particles must be transparent or semitransparent (as in the case of a liquid developer system). Optical window systems are also subject to problems of scumming and dust contamination.

Other prior art systems expose one or more test patches in non-image areas of the recording element. The measured optical density of the developed patches are good indications of the operation of the electrostatographic system, including the concentration of the development mixture. However, such systems require that a portion of the recording element be dedicated to the patches, either beyond the lateral edges of the image areas or in the interframe regions, thus making the equipment larger and the recording element more expensive. Toner particles are carried through the system but do not get transferred to receiver sheets. If improperly cleaned, the toner particles are a potential source of contamination of charges, optics, lamps, etc.

There is a suggestion in U.S. Pat. No. 4,200,665, which issued to K. Suzuki er al. on Apr. 29, 1980, at column 1, lines 56 to 66, that there are some prior art systems in which the toner is electrostatically attracted to the surface of an electrode plate to which a fixed voltage of the oppostite polarity to that of the toner is applied, or to the surface of a dielectric member which is electrically charged with a polarity opposite to that of the toner, followed by irradiation of the surface with light. The amount of light which has transmitted through or which is reflected from the surface is related to the amount of toner attracted to the electrode plate or dielectric member, and hence to the toner concentration in the developer mixture. If such a system does in fact exist in the prior art, it requires an electrical charging apparatus. As such, the system would require space for the charging apparatus, its cost would be increased by the cost of that apparatus, and would require additional electrical power to operate the charger. The additional power requirement would be an important consideration for battery-operated, portable copiers.

DISCLOSURE OF INVENTION

It is an object of the present invention to provide a toner concentration monitor which overcomes the problems associated with known monitors, such as for example the problems of scumming and dust contamination; the requirement that carrier and toner particles be either optically distinguishable, transparent or semitransparent; the need to dedicate a portion of the recording element to test patches; the risk of contamination by toner particles carried through the system on the recording element; and the requirement for an electrical charging system for a monitor.

In accoardance with these and other objects, the present invention provides a toner concentration monitor which includes a polarized dielectric member which, when dipped into a development mixture of carrier and toner particles, provides an accurate indication of the toner concentrationn of the mixture by the amount of toner particles which adhere to the member.

Another aspect of the present invention provides electrostatographic apparatus for controlling the concentration of toner particles in a development mixture wherein the apparatus includes a latent image development station for conveying toner particles from the development mixture to a latent image to be rendered visible. A polarized dielectric member is mounted for movement into and out of the development mixture, whereby toner particles in the development mixture are attached to the dielectric member in accordance with the concentration of toner particles in the development mixture. The amount of toner particles attached to the dielectric member when it is moved out of the development mixture is detected.

The polarized dielectric member is preferably an electret.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 3 is a schematic perspective view of the operation of another preferred embodiment of the present invention;

FIG. 4 is a schematic perspective view of the operation of yet another preferred embodiment of the present invention;

FIG. 5 is a schematic perspective view of the operation of still another preferred embodiment of the present invention; and FIG. 6 is a schematic perspective view of the operation of yet another preferred embodiment of the present invention.

BEST MODE FOR CARRYING OUT THE INVENTION

Figure 1:
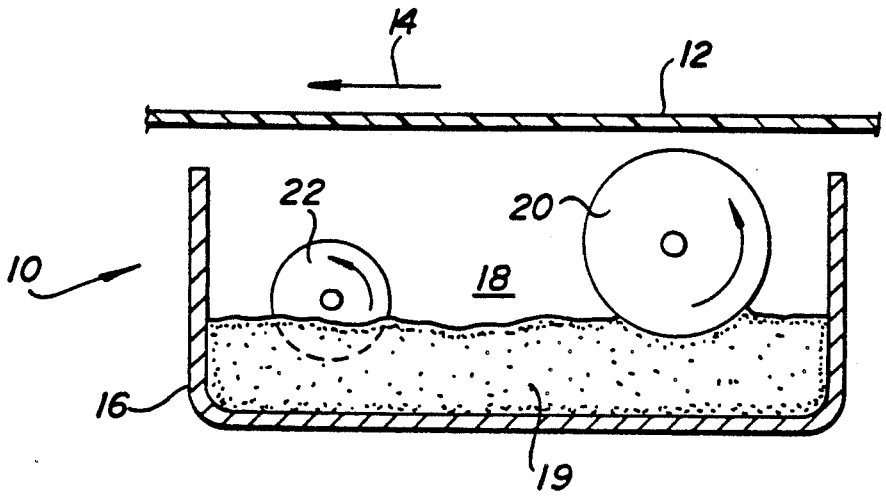
FIG. 1 is a schematic sectional view of a development station according to a preferred embodiment of the present invention.

Referring to FIG. 1 of the drawings, a development station of an electrostatographic apparatus is generally designated 10. It is used to develop latent electrostatic images of a surface of a dielectric recording element 12, such as a photoconductor, as the recording element is driven past the development staton in the direction indicated by an arrow 14.

Development station 10 includes a housing 16 which defined a chamber 18 containing a two-component development mixture 19 of carrier and toner particles that are to be furnished to latent images on recording element 12. A supply, not shown, of fresh toner supplies the development mixture with fresh toner particles when the mixture becomes depleted.

Development mixture is lifted from chamber 18 by a developer applicatior 20 such as a magnetic brush forming means having a plurality of magnetic poles that extend axially of the applicator with alternate poles in a circumferential direction comprising north and south poles. The mixture is magnetically held to the applicator such that rotation of the magnetic roller feeds development mixture upwardly so toner particles contact recording element 12 as the recording element moves past the development station. Toner particles which do not adhere to the receiver return with the carrier to chamber 18 along the back side of the applicator roller.

A toner concentration monitor, to be described in detail below, detects changes in the concentration of toner particles in the development mixture. The output of the toner concentration monitor drives a toner replenishment mechanism, not shown, which delivers fresh toner to the mixture from a toner supply. For example, the output of the toner concentration monitor may be compared with a reference signal representing a desired toner concentration level, and any difference between the monitor's output and the reference signal may be fed to a controller. See commonly assigned U.S. Pat. No. 4,607,944, which issued to A. J. Rushing on AUG. 26, 1986.

Figure 2:
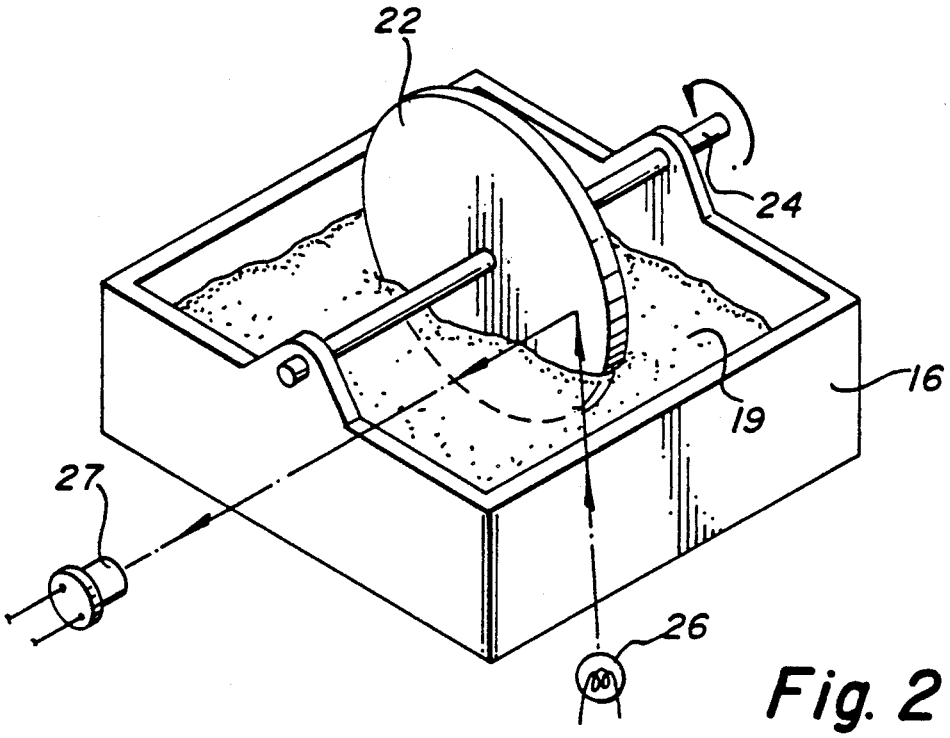
FIG. 2 is a schematic perspective view of the operation of a feature of the present invention.

In a preferred embodiment of the present invention the toner concentration monitor includes a slowly rotating disc 22, better seen in FIG. 2. Disc 22 is carried by a shaft 24 which is slowly rotated by driving means, not shown. The disc is partially submerged in development mixture 19.

Disc 22 is a polarized dielectric member such as an electret. Electrets are, by definition polarized dielectrics. They will accept and hold an electric charge. Although similar to magnets, electrets are not metallic. The classic method for producing an electret is to melt the dielectric material and apply a dc potential as it cools. Ceramic-type electrets, and some polymer types, can be made by simply heating them in a dc field. Electrets can also be produced with the aid of light or penetrating radiation; or in some instances in the presence of an electric field alone, without heat or applied radiation.

The volume of electret disc 22 is polarized opposite to the polarity of the toner particles in the development mixture. Toner particles are attracted to the disc face, the amount of toner particle adhering to the disc being in direct relation to their availability in the mixture. That is, the amount is in relation to the toner concentration of the mixture.

As disc 22 slowly rotates, the portion which has been submerged in the development mixture rises above the mixture level and is illuminated by a light source 26. The surface of disc 22 provides proper contrast, so optical density variations can be sensed by a photosensitive detector 27 to provide an electrical signal characteristic of the concentration of toner particles in the development mixture.

FIG. 3 shows a second preferred embodiment of the present invention. In this embodiment, electret disc 22′ is formed from transparent or translucent material. Once again, toner particles are attracted to the disc face, and the amount of toner particle adhering to the disc being in direct relation to the toner concentration of the mixture. The amount of light from source 26′ passing through the disc to photosensitive detector 27′ provides an electrical signal characteristic of the concentration of toner particles in the development mixture.

Referring to FIG. 4, a third preferred embodiment of the present invention includes a segment 28 of a disc. Here, the concentration is measured only intermittently. Segment 28 can be rotated slowly or pivoted (dunked) into the development mixture in a reciprocal motion. Clearly, there are many shapes that an electret may take within the scope of the present invention, as well as there being many different means for moving the electret into and out of the development mixture.

In the embodiments of the present invention described above, the electret disk or disk segment is moved through the development mixture by independent drive means. Referring to FIG. 5, one end of magnetic brush 30 is a flange 32 formed of electret material. As the magnetic brush rotates, flange 32 picks up toner particles and presents them for viewing by lamp 34 and detector 36.

Another way to move the electret through the development mixture is shown in FIG. 6. Here, it is assumed that the mixture itself is in motion as illustrated by arrow 38. Protrusions 40 on electret disc 42 turn the disc to present picked-up toner particles to a viewing system, not shown.

It will be apparent to those skilled in the art that the present invention provides many advantages over previously known devices. For example, toner particle concentration may be sensed on an intermediary which can be shaped in the most effective and convenient form. The electret member can be made from reflective material wherein the surface characteristics can be chosen to give good contrast, or the member may be transparent or translucent. The system can operate in the dark or lighted conditions, and is easily usable with liquid toner systems. The system is self-contained and will not add to toner contamination.

Other advantages include the self-cleaning characteristics of the electret as it moves through the development mixture. Since no optical window is needed, scumming is not a problem. The electret does not require recharging by an external power source, not is the mechanism affected by magnetic fields. The sensing mechanism distrubs the development mixture very little, and changes in carrier shape, material, or surface characteristics will not introduce a sensing error.

The invention has been described in detail with particular reference to preferred embodiments thereof, but it will be understood that variations and modifications can be effected within the spirit and scope of the invention.

What is claimed is:

1. A monitor for determining the concentration of toner in a development mixture of carrier and toner particles, said monitor comprising;

a polarized dielectric member;

means for intermittently submerging at least a portion of the member into development mixture to be monitored; and means for sensing the amount of toner particles which adhere to the member when withdrawn from the development mixture to provide an accurate indication of the toner concentration of the mixture by the amount of toner particles which adhere to the member.

2. A monitor as set forth in claim 1 wherein said polarized dielectric member is an electret.

3. A monitor as set forth in claim 1 wherein said polarized dielectric member is a rotating disc partially submerged in the development mixture.

4. A monitor as set forth in claim 1 wherein said polarized dielectric member is a rotating disc segment mounted to be intermittently at least partially submerged in the development mixture during rotation.

5. A monitor as set forth in claim 1 further comprising cylindrically shaped means rotatably mounted for forming a magnetic brush of development mixture; wherein said polarized dielectric member is a flange on one end of the magnetic brush forming means so as to be partially submerged in the development mixture during rotation of the magnetic brush forming means.

6. A monitor as set forth in claim 1 wherein said polarized dielectric member:

is a rotatable disc partially submerged in the development mixture; and includes means for rotating the disc upon movement of the development mixture.

7. A monitor as set forth in claim 1 wherein:

said polarized dielectric member is a rotating disc partially submerged in the development mixture; and said disc has a light reflective surface with a reflectivity contrasting the reflectivity of the toner particles of the development mixture.

8. A monitor as set forth in claim 1 wherein:

said polarized dielectric member is a rotating disc partially submerged in the development mixture; and said disc is at least partially light tansparent.

9. Electrostatographic apparatus for controlling the concentration of toner particles in a development mixture of carrier and toner particles, said apparatus comprising:

a chamber containing a development mixture of carrier and toner particles;

a latent image development station for conveying toner particles from the chamber to a latent image to be rendered visible;

a polarized dielectric member mounted for movement into and out of the development mixture in the chamber, whereby toner particles in the development mixture are attached to the dielectric member in accordance with the concentration of toner particles in the development mixture; and means for detecting the amount of toner particles attached to the dielectric member when it is moved out of the development mixture.

10. A monitor as set forth in claim 9 wherein said polarized dielectric member is an electret.

* * * * *